US006131759A

United States Patent [19]

Young

[11] Patent Number: 6,131,759

[45] Date of Patent: Oct. 17, 2000

[54] INTEGRALLY STRUCTURED YARD WASTE BAGGING MEANS

[76] Inventor: Roger L. Young, 2515 High School Dr., Brentwood, Mo. 63144

[21] Appl. No.: 09/258,588

[22] Filed: Feb. 26, 1999

Related U.S. Application Data

[60] Provisional application No. 60/076,509, Mar. 2, 1998.

[51] Int. Cl.[7] ..... B65D 1/06

[52] U.S. Cl. ..... 220/495.11; 220/908.3; 220/908.1

[58] Field of Search ..... 220/908.3, 908.1, 220/495.11

[56] References Cited

U.S. PATENT DOCUMENTS

| | | | |
|---|---|---|---|
| D. 256,770 | 9/1980 | Broyles . | |
| 2,688,429 | 9/1954 | Davison . | |
| 2,827,931 | 3/1958 | Melvin . | |
| 3,191,798 | 6/1965 | White et al. | 220/908.3 |
| 3,434,625 | 3/1969 | Embry, Jr. | 220/908.3 |
| 3,818,956 | 6/1974 | Chamberlain . | |
| 4,037,778 | 7/1977 | Boyle . | |
| 4,133,356 | 1/1979 | Dillingham . | |
| 4,158,995 | 6/1979 | Kaplan et al. . | |
| 4,248,278 | 2/1981 | Blodgett . | |
| 4,485,855 | 12/1984 | Dillingham . | |
| 4,878,590 | 11/1989 | Porter | 220/890 |
| 4,890,652 | 1/1990 | Hoerner . | |
| 5,090,309 | 2/1992 | Lai . | |
| 5,129,609 | 7/1992 | Tobin . | |
| 5,271,589 | 12/1993 | Belous . | |
| 5,292,093 | 3/1994 | Shumake . | |
| 5,632,401 | 5/1997 | Hurd | 220/407 |
| 5,765,614 | 6/1998 | Kardosh . | |

*Primary Examiner*—Stephen Castellano
*Attorney, Agent, or Firm*—Paul M. Denk

[57] ABSTRACT

A structured yard waste bagging device, for use in combination with polyethylene, paper, or other bags, includes an injection molded polymer cylindrical member, which may be formed of a rectangular, square, round, or the like, in cross-section, having an integral upper funnel or cone shaped portion extending upwardly therefrom. The cylindrical portion includes means for desirably holding the yard waste bag in position, stretched around the cylindrical portion during usage of this bagging device, so that when refuse is deposited into the bagging member, packed down, and when filled to capacity, the bagging member can be removed, leaving all of the yard waste conveniently already deposited into the bag, and ready for tying, removal, and disposal.

5 Claims, 8 Drawing Sheets

203
221a
202
221
231
223
223a
221b
227
229
223b
225

206
209
207
205
213
211

203
233
221
223
231

203
221
221a
233
223
223
231

202
202

INTEGRALLY STRUCTURED YARD WASTE BAGGING MEANS

CROSS-REFERENCE TO RELATED APPLICATIONS

This application is related to Provisional Patent Application No. 60/076,509 filed Mar. 2, 1998, and which is incorporated herein by reference.

STATEMENT REGARDING FEDERALLY SPONSORED RESEARCH OR DEVELOPMENT

Not Applicable.

BACKGROUND OF THE INVENTION

This invention relates generally to the bagging of yard waste, and more specifically, pertains to means to facilitate the collection of yard waste by only a single individual, and which invention can be manipulated easily by the worker, during its application and usage.

Attempting to accumulate yard waste, whether it be leaves, grass, mulch, or any other materials, and package it for either waste disposal, shipment, or transfer to another area of the yard, or to the front of the yard for waste pickup, has always been a problem. Efforts to simply bag leaves, once they have been raked into a pile, generally require at least two to three workers. There have been some mechanisms made that assisted in the collection of yard waste. For example, a cardboard box surrounded by a bag has been used to assist in the packaging and disposal of grass. In addition, various types of compost kits, generally comprising a walled vessel, usually aerated through the location of a variety of perforations, and having a lid for covering the same, has been available in the art. But this is primarily available for more permanent usage, located at the back of the yard, where waste can be gathered, collected, and composed, over a period of time.

The current invention remedies some of these problems associated with the collection of such yard waste refuse, facilitates the gathering of leaves, grass and the like, within its erected container, which container is already installed for usage, and can be applied within a bag, whether it be paper or polymer bag, for facilitating the bagging of such yard waste and leaves, for either disposal, or for composting purposes.

SUMMARY OF THE INVENTION

It is the principal object of this invention to provide means to facilitate the gathering, collection, and bagging of yard waste, such as leaves, grass, and the like, through the use of a permanently erected and structured container, for use in conjunction with bagging materials, for the collection of such yard waste.

This invention contemplates the formation and erection of a yard waste bagging means, that is generally comprised, when used, of two components. Initially, it incorporates a structured cylindrical means, which has a funnel shape flaring at its upper edge, the cylindrical means generally having the same height as the bag into which the leaves are to be raked, and which can be assembled into the bag, thereby holding the bag into its opened configuration, surrounding the cylindrical means, while leaves, and other yard waste, may be directly applied by means of the upper funnel means, into the bag, during its filling.

The bagging means of this invention is used in conjunction with the standard yard bags, whether they be of the forty gallon size, or the like, with the dimensions of the bagging means being designed so that it can be fabricated of differing sizes, in order to fit within and accommodate the type of yard bags normally used by the home owner. The subject matter of this invention is to provide a bagging means that can eliminate the difficulty of putting leaves into the yard bag, simply because it is difficult to hold the top of the bag open, during deposit of the leaves into the bag, and to hold the bag upright, during performance of such work.

The bagging means of this invention is very advantageous, when used, because its lower cylindrical means holds the polymer or paper yard bags opened, and in an erected position, and through the use of its associated top funnel, can readily receive the deposit of leaves, grass, and other yard waste directly into the bag, without too much effort.

Another object of this invention is to provide a structured yard waste bagging means that integrates a funnel configuration at its upper end, and wherein the cylindrical shape for the bagging means may be rectangular or square of configuration, in addition to its upper funnel means, in order to facilitate its use, storage, and also resting upon the ground, as when leaves are raked into it, for their deposit into the associated bag.

The bagging means of this invention may be fabricated from any type of polymer, or injection molded in place, preferably within the vicinity of point 0.050 inches, or more, in thickness, in order to add substantial strength and structural rigidity to it, during usage, as when applied within the bag, during its application. As stated, the bagging means may be fabricated into a circular cylindrical configuration, including its upper funnel means, or it may be of a rectangular or square design, as desired. Such will be determined when it is injection molded, in the type of mold that is used for such process of manufacture of these structured yard waste bagging means. The funnel may be separate from, or integrally formed with, the bottom portion of the bagging means.

When the bagging means of this invention is assembled, and ready for use, and it is inserted into the polyethylene or other type of polymer bag, or a paper bag, and is then inserted into one of such yard waste bags, and the entire combination is then stood on an end, with the funnel shape means directed upwardly, it is ready for the deposit of leaves, and the like, therein, during application. As is also available through usage of the bagging means of this invention, the entire assembly, once it has been located within a bag, can be laid on its side, and the funnel portion rested upon the ground where it contacts or is arranged contiguously therewith, so that leaves or grass can then be raked directly up onto the funnel portion, and pushed into the bag, for collection. Once that is achieved, or once the bag is reasonably filled, it can be stood on end, to provide for a packing downwardly of the leaves and grass, within the bag, for further filling. Once a bag is completely filled, the bagging means of this invention may be simply slid upwardly, removed from the polymer or paper associated bag, and under this condition, the bag can be simply closed at the top, and otherwise secured or held closed by means of a twist-tie, or the like, for cartage or other disposition.

DESCRIPTION OF THE PREFERRED EMBODIMENT

Figure 6:
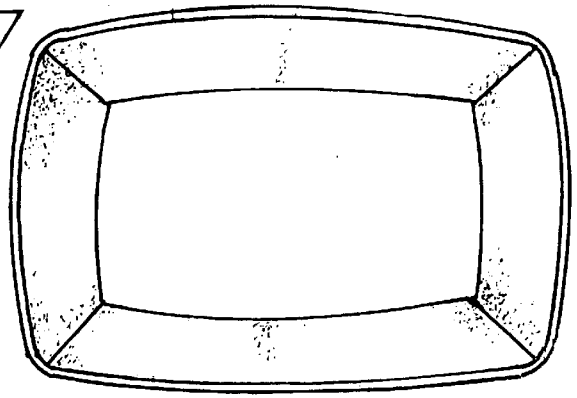
FIG. 6 is a top plan view of the bagging means of FIG. 4.
Figure 7:
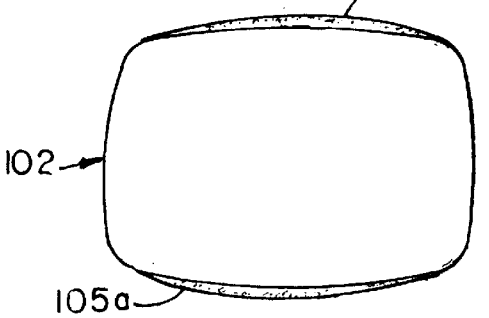
FIG. 7 is a top plan view of just the base part of the bagging means of FIG. 4.
Figure 8:
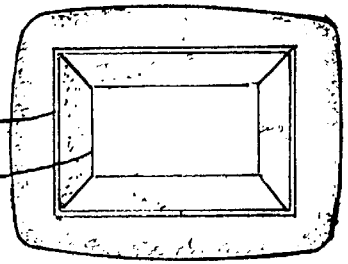
FIG. 8 is a bottom plan view of the base part of the bagging means of FIG. 4.
Figure 2:
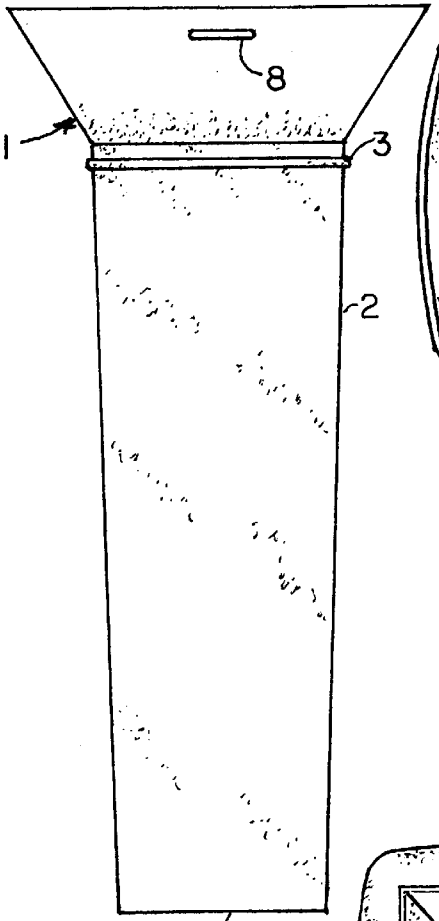
FIG. 2 is a side elevational view of the bagging means.
Figure 1:
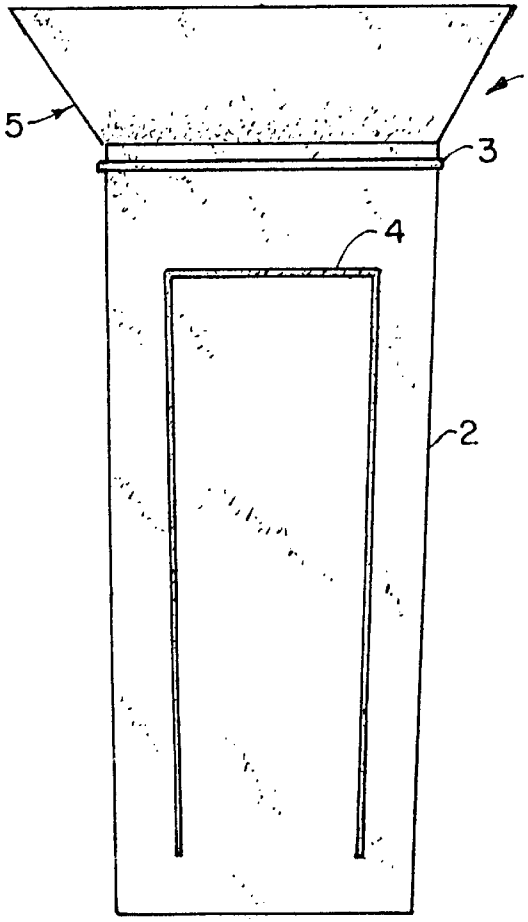
FIG. 1 is a front elevational view of a bagging means of the present invention, for eventual use with a yard waste bag.

In referring to the drawings, and in particular FIGS. 1 and 2, the yard waste bagging means 1 is of an integral structure. The bagging means 1 has dimensions, at least in cross-section, that approximate the internal dimensions of one of the standard yard bags, whether of plastic or polymer type, that are used for bagging of yard waste, such as leaves, grass clippings, and the like. In addition, the height of the base portion 2 of the structured bagging means is of sufficient elevation so as to fit within the full height of a bag, once inserted therein. And, at the approximate upper edge of the cylindrical portion is provided an integral bead, as at 3, so that when the upper edge of the bag reaches this vicinity, and is stretched over the bead, it will be held in place, during the bagging of leaves, yard waste, and the like. As can also be seen upon the side wall of the cylindrical portion, there are various integrally formed ribs, as at 4, provided for reinforcement purposes. This is so because the entire structure of the integral bagging means is molded of a polymer, and in order to reduce costs, it is desired to fabricate it of as thin a polymer wall as possible, but yet have sufficient rigidity, so that it will stand erect, on its own, when set upon the ground.

Figure 3:
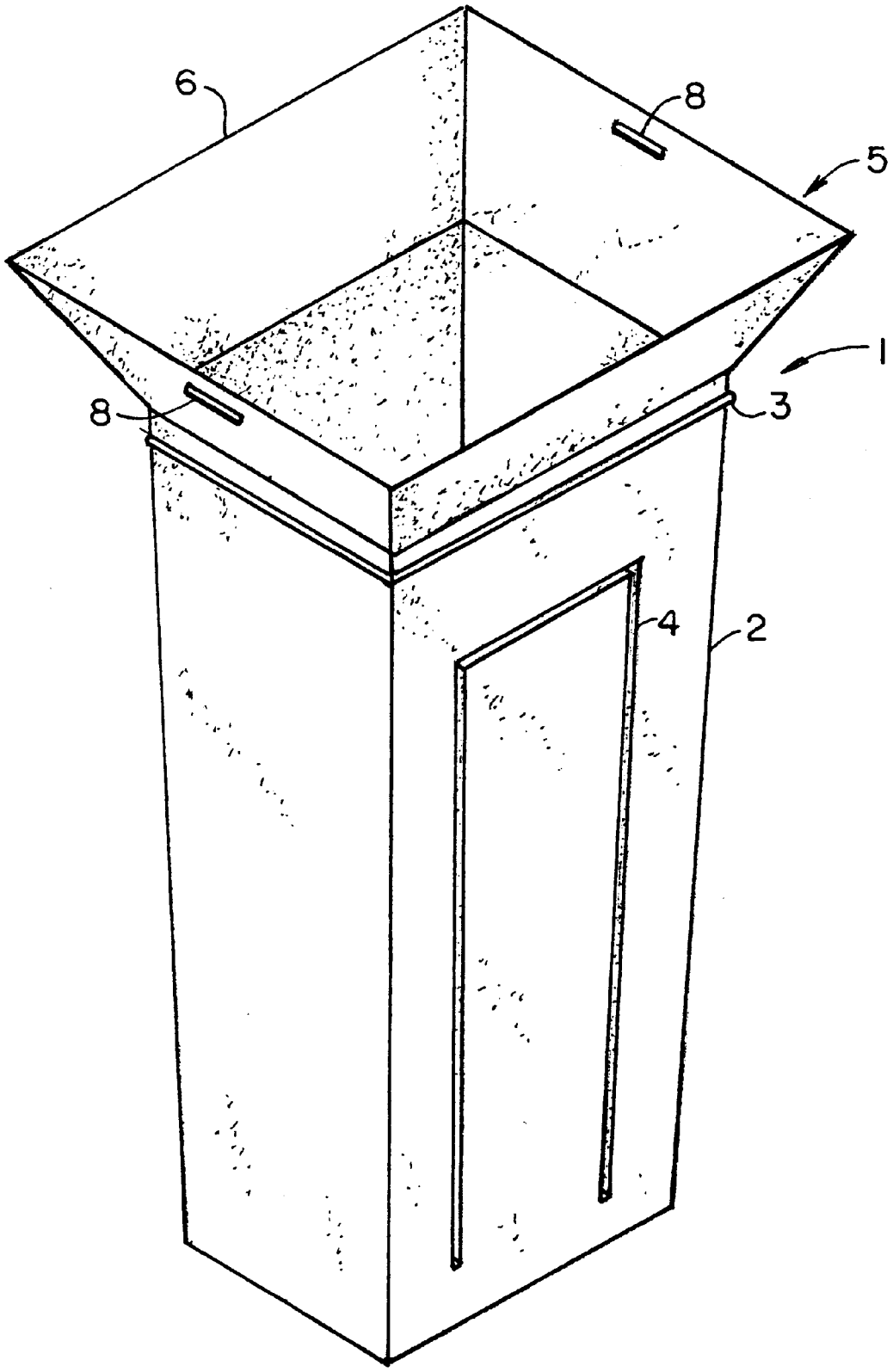
FIG. 3 is a top isometric view of the yard waste bagging means.

As can also be seen in FIG. 3, the base portion 2 of the bagging means is generally of rectangular shape, although it may be made round, square, or to other configurations. In any event, the base portion 2 also has a slight taper, downwardly, so that a series of these integrally structured bagging means may be inserted, one within the other, as when they are shipped or stored, or when they are displayed within the store for sale, or even can be stored in such manner by the homeowner, in the event that he/she should use a number of these, for their convenience when doing yard work.

Integrally formed extending upwardly from the upper edge of the base portion 2, is a funnel portion 5, that is shaped like a rectangular cone, so that the entire assembly can be laid upon its side, and leaves and grass can be raked directly onto the device 1. When the bagging device 1 is laid on its side, the funnel portion 5 will collapse slightly, at the vicinity of its edge 6, so as to conform to the surface of the ground, where it contacts the ground, and offers a function similar to that of a dust pan, or the like, that allows the grass and leaves to be raked directly thereon, and into the base portion 2, during deposit of yard waste therein. The device can even be laid upon the ground, when the polymer bag or paper bag is applied thereto, so that when the entire base portion 2 becomes filled, and the structured bagging means 1 is raised into its elevated position, standing on the ground, the yard waste may be compacted downwardly, such that when the bagging means is removed, the yard waste will drop out of the opened bottom, as at 7, into the plastic or paper bag, and be located therein, ready for closure, and disposal.

As can also be seen in FIG. 3, the upper edges of the funnel means may contain some hand openings, as at 8, in order to facilitate the handling of the structured bagging means, and its locating within the yard bag, or its removal therefrom, during its usage.

The integral structured bagging means of this invention may be injection molded from any of the various polymer materials, such as polyethylene, polypropylene, or any of the other polymers that are readily available for injection molding, into a thin walled but integral structure, of the type as described and designed herein.

The concept of this invention is obviously designed to provide means for facilitating the raking of leaves, grass, and other yard waste into a yard bag, usually a feat that is difficult to perform, particularly when the home owner or yard man is working alone. The advantage of utilizing the structured funnel shaped bagging means of this invention is designed to hold a yard bag in an opened condition, affixed to the cylindrical base of the bagging means, affords a top cone or funnel shape member upwardly, to facilitate and make it easier to put yard waste into the bag. Once the device has been used, it can then be easily stored, or if a plurality of them are used, simply nested together, for storage, in the manner as previously reviewed.

Figures 4, 5, 5A, 5B, 9:
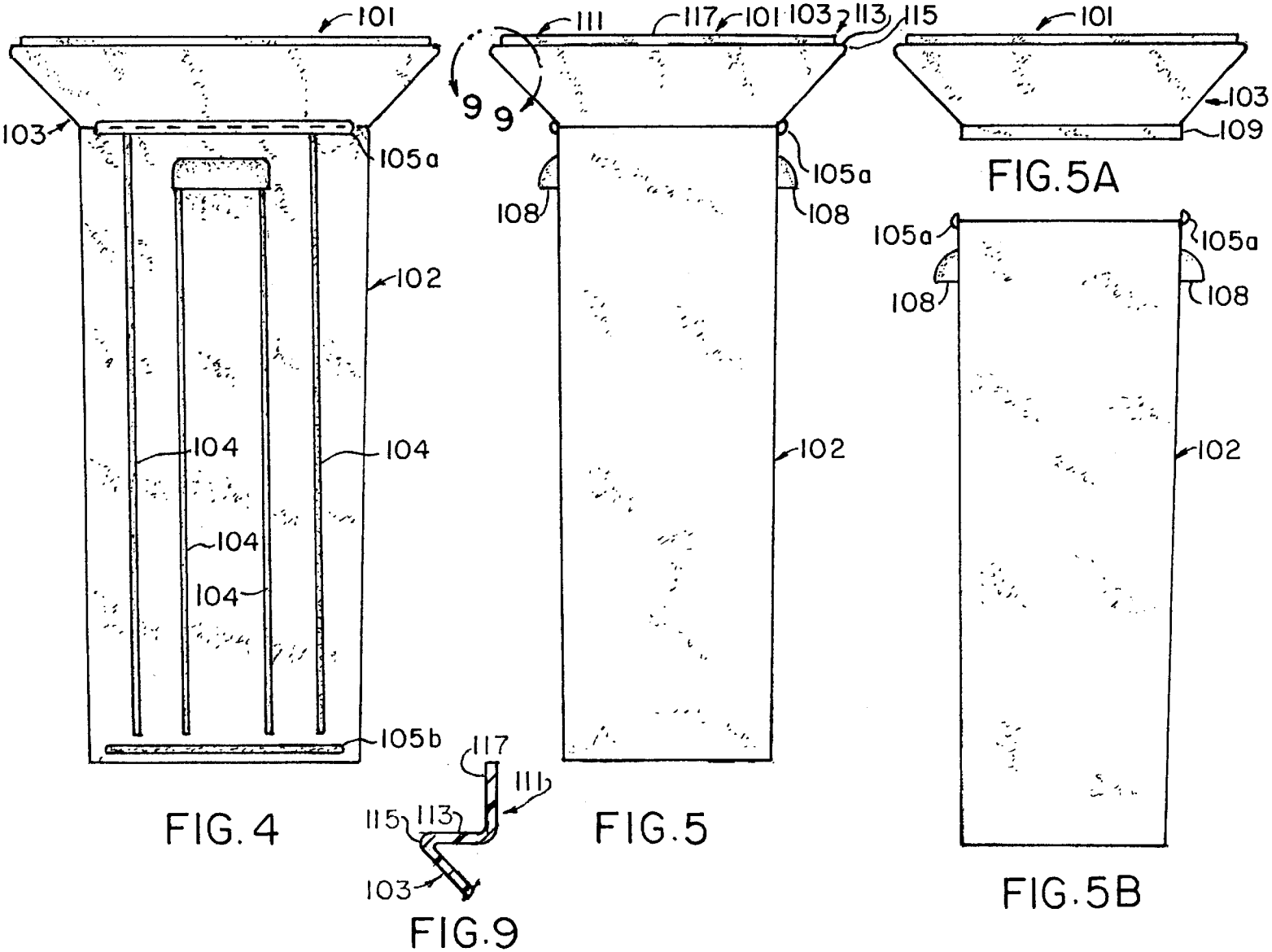
FIG. 4 is a front elevational view of a modified bagging means, the bagging means having ribbed sides.
FIG. 5 is a side elevational view of the bagging means of FIG. 4.
FIG. 5A is a side elevational view of the funnel portion of the bagging means of FIG. 4.
FIG. 5B is a side elevational view of the base portion of the bagging means of FIG. 4.
FIG. 9 is an enlarged cross-sectional view taken along line 9—9 of FIG. 5, showing disclosing a molded bent configuration of the upper perimeter edge of the funnel means to reinforce the funnel means at that location.
Figure 13:
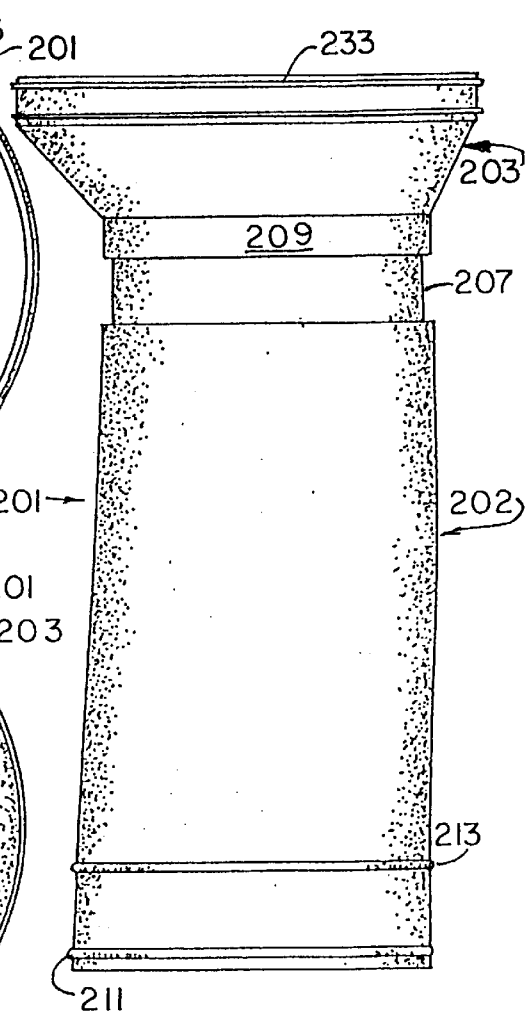
FIG. 13 is a side elevational view of the bagging means of FIG. 10.
Figure 11:
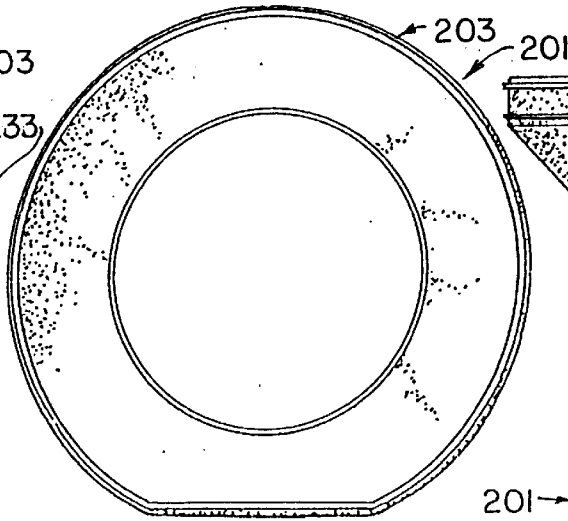
FIG. 11 is a top plan view of the bagging means of FIG. 10.
Figure 12:
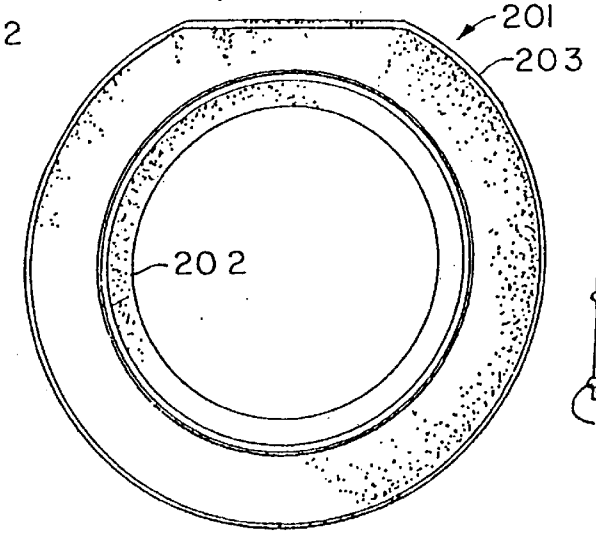
FIG. 12 is a bottom plan view of the bagging means of FIG. 10.

FIG. 4 is a front view of a modified bagging means 101 of the invention. The bagging means 101 includes a base portion 102 and a funnel portion 103. The base portion 102 includes parallel ribs 104 which extend vertically down the front of the base, and horizontal ribs 105*a, b* which extend across the upper and lower edges, respectively of the base 102. The ribs 104 and 105 are provided for reinforcement purposes. The upper rib 105*a* also acts to hold the yard bag in place on the bagging means 101. FIG. 5 provides a side view of the bagging means of FIG. 4, and shows handles 108 which extend from sides of the base portion 102 to facilitate lifting of the bagging means 101.

As shown in FIGS. 5A and 5B, the bagging means 101 is a two part assembly, with the funnel portion 103 being separate from the base portion 102. The funnel portion 103 has a neck 109 which is fits within the top edge of the base portion 102 to mount the funnel 103 to the base 102. The fit between the neck 109 and the base 102 is sufficiently tight that that funnel 103 will not simply slip off of the base 102.

As shown in FIG. 9, the upper periphery 111 of the funnel portion 103 has a bent configuration, such as having a Z-shape, to reinforce the upper perimeter of the bagging means. That is, an inwardly directed shoulder 113 extends around the circumference of the top edge 115 of the funnel portion 103, and a lip 117 extends upwardly from the inner perimeter of the shoulder 113.

The base portion 102 has walls which slope or tapers generally inwardly. Thus, multiple base portions can be nested together save space in a store when the items are offered for sale. Similarly, the slope surfaces of the funnel portion allow a plurality of the funnels to be nested together.

A third embodiment of the bagging means is shown generally in FIGS. 10–13. The bagging means 201 includes a base portion 202 and a separate funnel portion 203 which is received on the base portion 202.

Figures 17, 18, 19, 20, 21, 22:
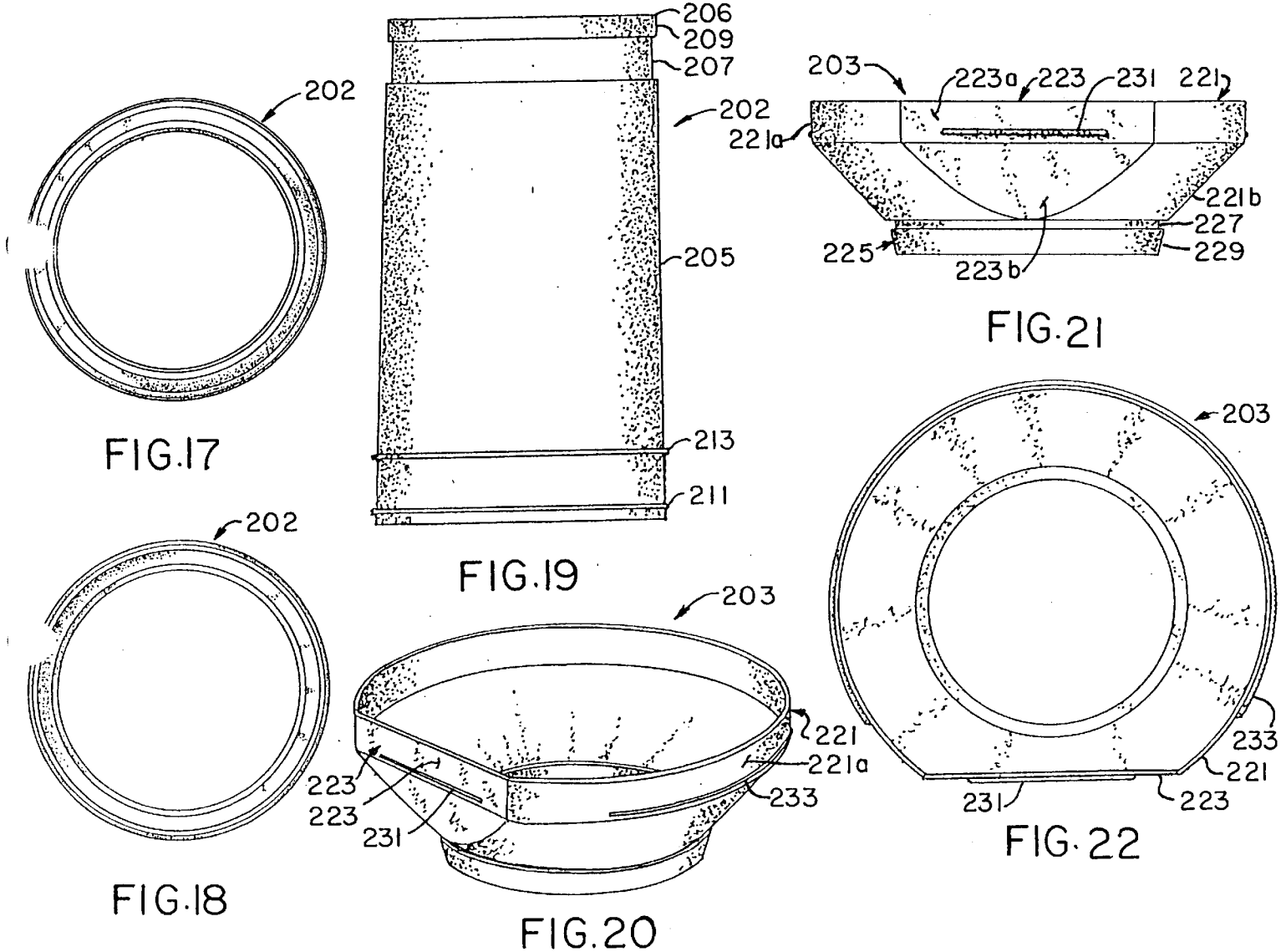
FIG. 17 is a top plan view of the base portion.
FIG. 18 is a bottom plan view of the base portion.
FIG. 19 is a side elevational view of the base portion.
FIG. 20 is a perspective view of a funnel portion of the bagging means of FIG. 10.
FIG. 21 is a front elevational view of the funnel portion.
FIG. 22 is a top plan view of the funnel portion.
Figure 25:
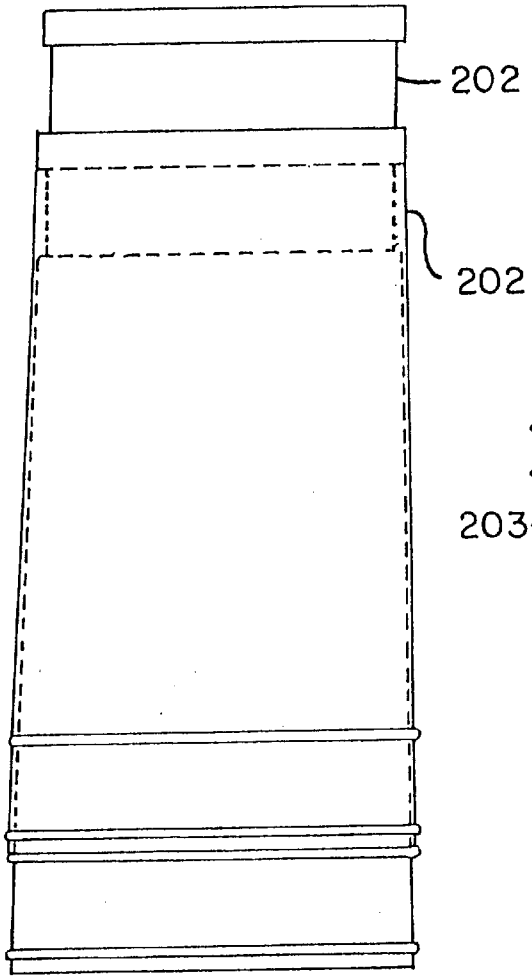
FIG. 25 is a side elevational view of stacked funnel portions.
Figure 23:
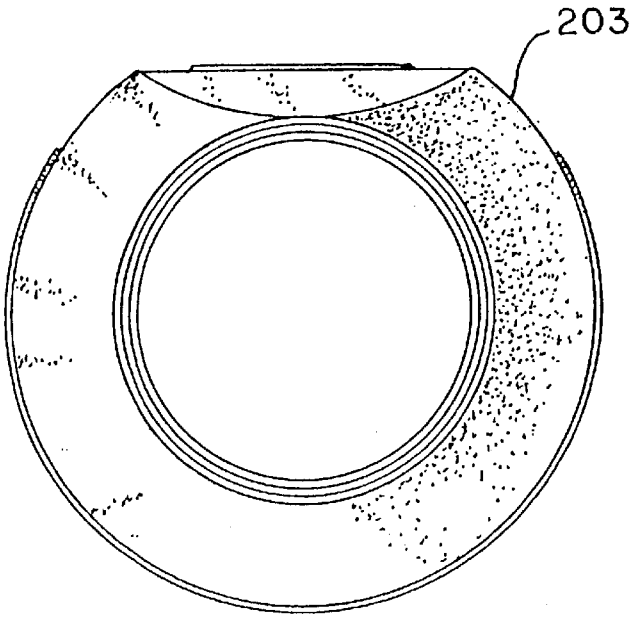
FIG. 23 is a bottom plan view of the funnel portion.

The base portion 202 is generally cylindrical in plan, as seen in FIGS. 17 and 18 and has a generally circular side wall 205. The base portion is preferably hollow, and comprises an open ended tube. The base portion 202 slopes slightly, such that it is wider at its bottom, than at its top. This allows base portions to be stacked together, as seen in FIG. 25. The diameter of the base portion, at its top, is preferably no larger than the diameter of a waste collection or garbage bag into which the yard waste will be collected. The garbage bag is inserted inside the base portion 202 and the top edge of the bag is stretched over the top edge 206 of the base portion. The base portion includes a circumferential groove 207 spaced from the top edge 206 which defines a lip 209 at the top edge 206. When the bag is inserted in the base portion 202, the bag is stretched out over the lip 209. The base portion 202 also includes a pair of circumferential rings or ribs 211 and 213 spaced from the bottom of the base portion. The rings 211 and 213 form stops when base portions are stacked together, for example, for transportation to, and display at, a store. The rings 211 and 213 reduce the amount of area over which stacked base portions contact each other. This will make it easier to remove a top base portion from a lower base portion.

The funnel 203 is shown in more detail in FIGS. 20–23. The funnel 203 has a curved side wall 221 which forms an arc of about 285°. The side wall 221 includes an upper section 221*a* which forms a generally vertical band when the funnel is positioned in the base portion. A sloped side wall 221*b* is formed below the upper side wall 221*a*. A flat side wall 223 extends between the ends of the curved side wall 221. The flat side wall 223 also includes an upper portion 223*a* and a lower sloped portion 223*b*. The side walls 221 and 223 slope downwardly and inwardly, as noted, and end in a generally circular throat 225. The throat 225 is stepped outwardly, as at 227, and includes an inwardly sloped side wall 229 below the stepped surface 227. The throat 225 is sized so that it can be frictionally received in the top of the base portion 202.

Figure 10:
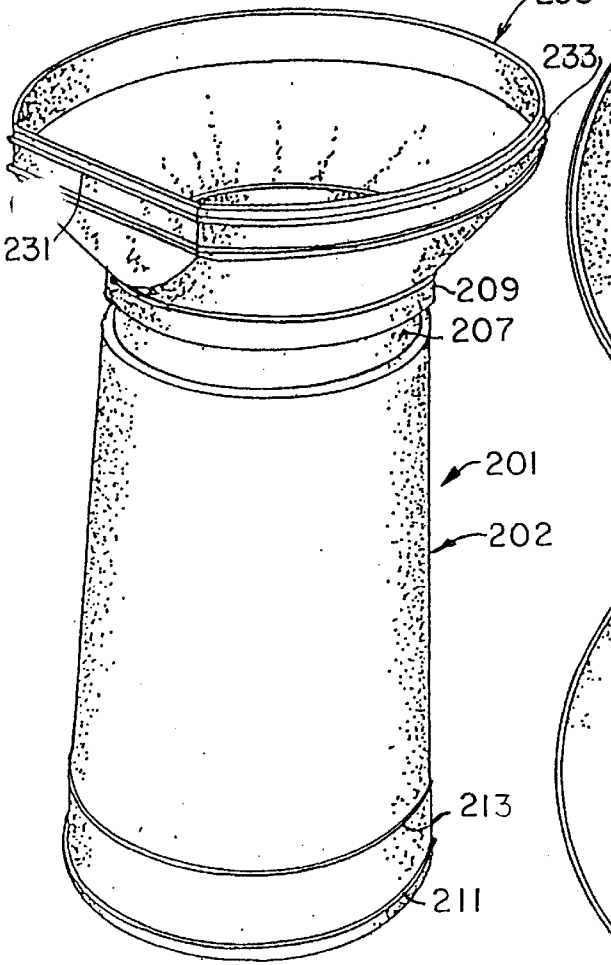
FIG. 10 is a perspective view of a two-piece bagging means.
Figures 14, 15, 16:
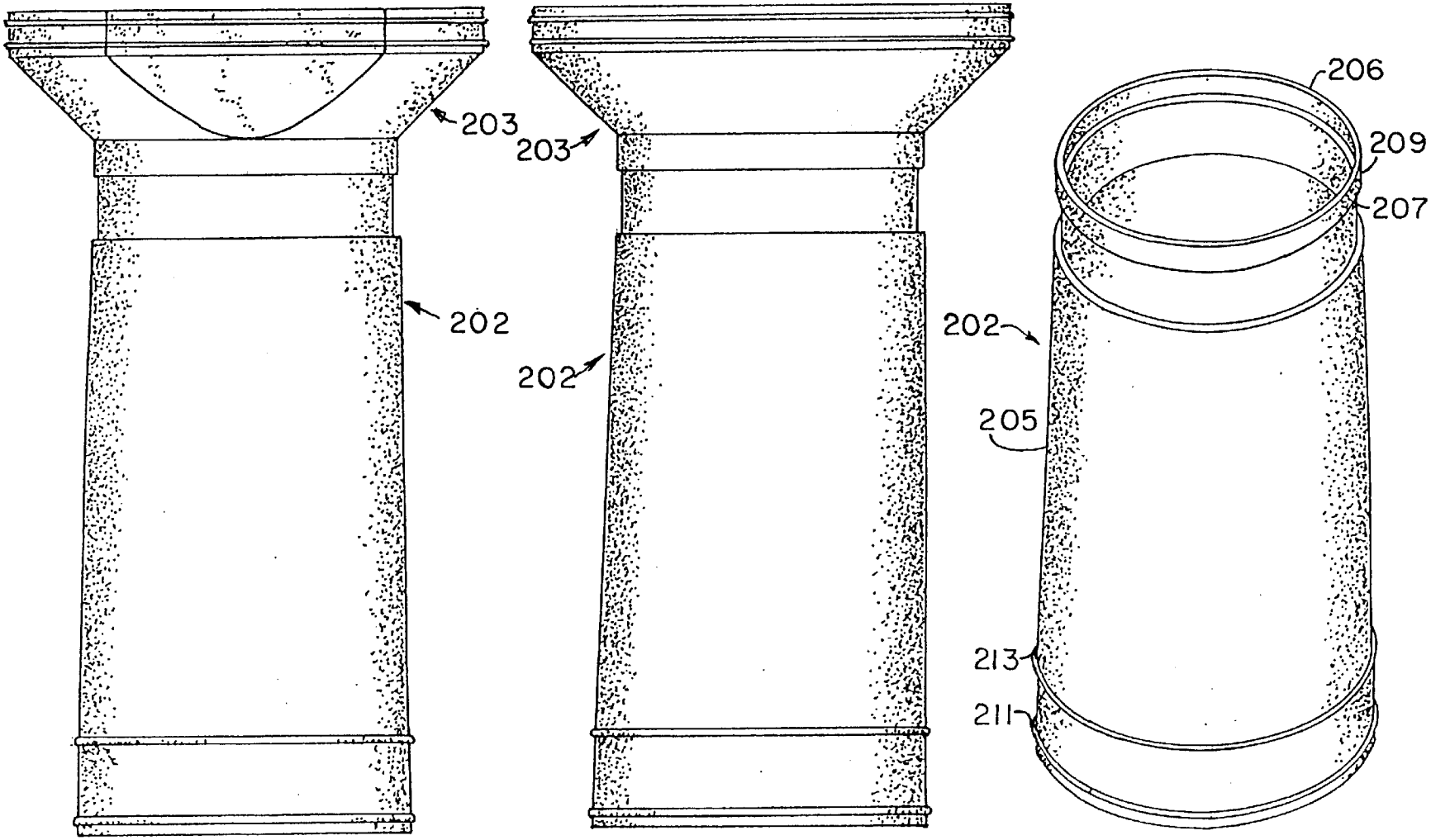
FIG. 14 is a front elevational view of the bagging means of FIG. 10.
FIG. 15 is a back elevational view of the bagging means of FIG. 10.
FIG. 16 is a perspective view of a base portion of the bagging means of FIG. 10.
Figure 24:
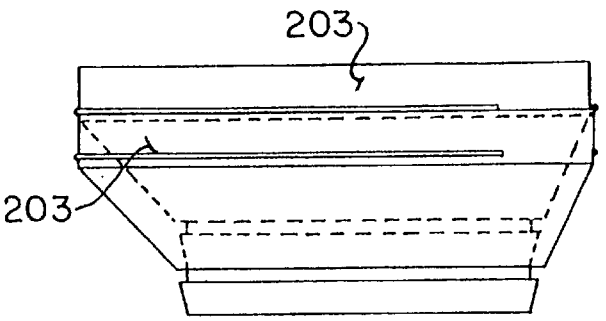
FIG. 24 is a side elevational view of stacked base portions.

The sloped shape of the funnel 203 enables multiple funnels to be stacked together for transportation and display, as shown in FIG. 24. To reduce the amount of area over which stacked funnels include a first rib 231 on the upper flat wall 223*a* and a second rib 233 on the upper curved wall 221*a*. The ribs 231 and 233 can be continuous, as shown in FIG. 10, or discontinuous, as shown in FIG. 20. Further, there can be one rib 231 and one rib 233, as shown in FIG. 20, or there can be a pair of parallel ribs 231 and 233, as shown in FIG. 10.

In use, once the collection bag has been inserted in the base portion 202, the funnel 203 is inserted in the base portion. The bag will then be sandwiched between the funnel throat 225 and the inner surface of the base portion. This will help ensure that the bag is not accidentally removed from the collection device 201. The collection device 201 can be stood upright, on its base, and yard waste can simply be dropped into the funnel 203 and into the bag. Alternatively, the collection device can be laid on its side, so that the flat wall 223 of the funnel is against the ground. This will create a flat area over which leaves, grass, etc. can be racked into the funnel 203 and into the bag.

Figure 27:
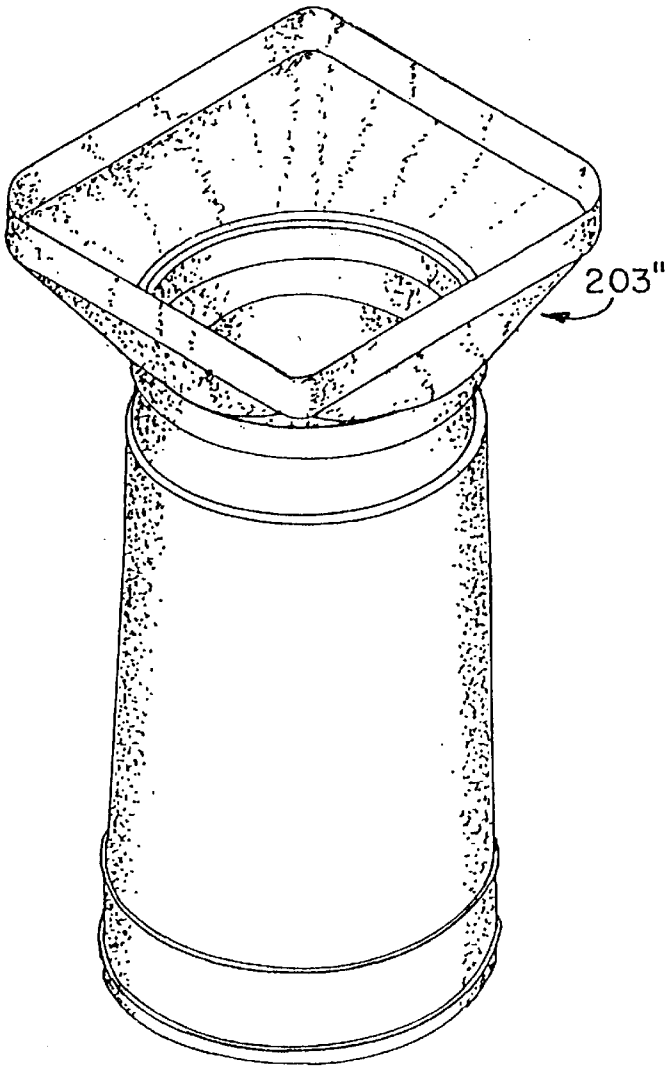
FIG. 27 is a perspective view of the bagging means with a generally square funnel portion.
Figure 26:
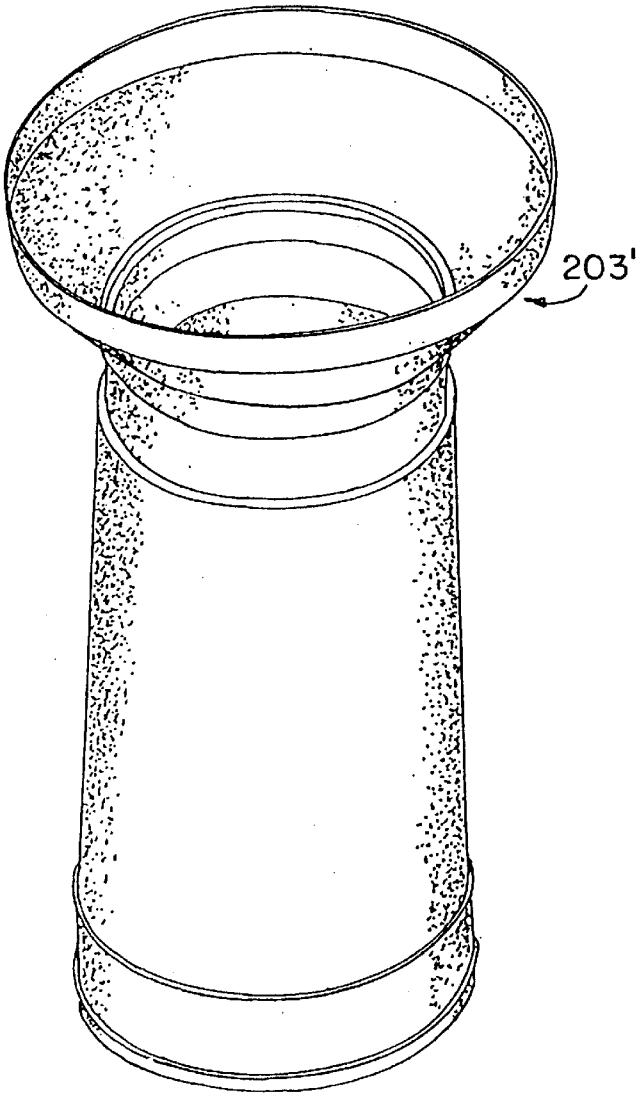
FIG. 26 is a perspective view of the bagging means with a circular funnel portion.

Further variations of the funnel are shown in FIGS. 26 and 27. In FIG. 26, the funnel 203' is circular in plan. In FIG. 27, the funnel 203" is square in plan.

Variations or modifications to the subject matter of this invention may occur to those skilled in the art upon review of the description of the invention provided herein. Such variations or modifications, if within the spirit of this invention as described herein, are intended to be encompassed within the scope of this disclosure. The description of the preferred embodiment, and the illustrations of the invention as set forth in the drawings, are provided for illustrative purposes only.

What is claimed is:

1. A yard waste collection device for use in combination with a yard waste collection bag, said device including a base portion and a funnel above the base portion, said funnel when installed upon the base portion flaring upwardly and outwardly from said base portion, said base portion being sized at its top so that the yard waste collection bag locates in the base portion, and can be spread over the base, the base having a sloped side wall that slopes inwardly and downwardly along its length, and said base portion have a lip near the top of the side wall, the slope of the base portion being sufficient to enable the base portions to be stacked together, the funnel having a throat which communicates with the interior of the base portion, and said funnel flaring upwardly and outwardly from its throat, the upper edge of the funnel includes Z-shaped configuration to structurally reinforce the funnel during usage.

2. The yard waste collection device of claim 1 wherein the base portion wall slopes inwardly, the top of the base portion at its lip have a diameter greater than the diameter at the bottom of the base portion, the collection bag is received in the base portion.

3. The yard waste collection device of claim 1 wherein the funnel is separate from the base portion; the funnel throat having a surface sized to be frictionally received in the base portion, whereby the frictional fit of the funnel throat in the base portion holds the bag in place.

4. The yard waste collection device of claim 3 wherein the bag is received in the base portion, and said bag spreads over the lip of the base portion and held therein through reception of the funnel throat within the lip of the base portion when the funnel and base portion are assembled for usage.

5. The yard waste collection device of claim 1 wherein a series of funnels may be stacked together when separated from their base portions.

* * * * *